US006899482B2

(12) United States Patent
Katami

(10) Patent No.: US 6,899,482 B2
(45) Date of Patent: May 31, 2005

(54) WRITING INSTRUMENT

(75) Inventor: Kazunori Katami, Tsurugashima (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/440,262

(22) Filed: May 19, 2003

(65) Prior Publication Data

US 2003/0215279 A1 Nov. 20, 2003

(30) Foreign Application Priority Data

May 17, 2002 (JP) ..... 2002-143413

(51) Int. Cl.[7] ..... B43K 27/00
(52) U.S. Cl. ..... 401/31; 401/29
(58) Field of Search ..... 401/29, 31, 99

(56) References Cited

U.S. PATENT DOCUMENTS 3,170,441 A 2/1965 Levoin
3,260,242 A * 7/1966 Liguori ..... 401/31
5,749,663 A * 5/1998 Takahashi ..... 401/31

FOREIGN PATENT DOCUMENTS

FR 1 261 212 A 5/1961
WO WO 01/03948 A1 1/2001

* cited by examiner

*Primary Examiner*—Tuan Nguyen
(74) *Attorney, Agent, or Firm*—Sughrue Mion, PLLC

(57) ABSTRACT

A multi-color writing instrument such as a ballpoint pen or mechanical pencil, which is adapted such that a selection of a writing color can be easily performed even under poor lighting conditions and/or by a person with poor eyesight. The writing instrument includes a plurality of reservoir tubes containing different writing colors, which are accommodated in a barrel. Operating portions are provided on the reservoir tubes and exposed outside the barrel. The operating portions can be differentiated from each other by touch. Thereby a specific one of the reservoir tubes can be selected by the operating portions for use.

8 Claims, 6 Drawing Sheets

WRITING INSTRUMENT

FIELD AND BACKGROUND OF THE INVENTION

The invention relates to a writing instrument such as a ballpoint pen or mechanical pencil, having plural reservoir tubes possessing different writing colors.

A two-color ballpoint pen of different colors, for example, of black and red and a multiple-color ballpoint pen in which a suitable color such as blue is added to the former colors, or a writing instrument in which a ballpoint pen and a mechanical pencil are integrated has been widely known.

In case where an optional writing color is selected from plural different writing colors, it is selected by an operating portion relating to each writing color. However, since the operating portion has the same shape for all writing colors, the selection of the writing color has been exclusively performed only by a visual confirmation. Therefore, a person with poor eyesight can not use it and, even for people in general, the selection of the writing colors has been difficult when writing such as memorandum in a gloom place.

OBJECTS OF THE INVENTION

It is an object of the present invention to provide an improved multi-color writing instrument such as a ballpoint pen or mechanical pencil. Another object of the present invention is to provide a multi-color writing instrument such as a ballpoint pen or mechanical pencil, which permits easy recognition and judgment in the selection of a specific color, prevents an error of discrimination in a gloomy place or the like for users in general, and which allows users with poor eyesight to easily select a writing color.

SUMMARY OF THE INVENTION

These and other objects are attained in accordance with the present invention by a writing instrument adapted such that plural reservoir tubes having different writing colors are accommodated in a barrel, operating portions provided in the reservoir tubes are exposed outside the barrel, and any of the reservoir tubes is selected by the operating portion associated and used, in which touch feelings of the operating portions of the reservoir tubes are mutually differentiated.

According to preferred embodiment of the invention the external shapes of the operating portions of the reservoir tubes are mutually differentiated in order to provide different touch feelings to the operating portions.

According to another preferred embodiment of the invention convex portions or concave portions are provided in the operating portions, and the shapes of the convex portions or the concave portions in the operating portions of the reservoir tubes are mutually differentiated.

According to still another preferred embodiment of the invention convex portions or concave portions are provided in the operating portions, and the number of the convex portions or the concave portions in the operating portions of the reservoir tubes are mutually differentiated.

According to still another preferred embodiment of the invention convex portions or concave portions are provided in the operating portions, and the positions of the convex portions or the concave portions in the operating portions of the reservoir tubes are mutually differentiated.

Preferably the hardness of the operating portions of the reservoir tubes are mutually differentiated in order to provide different touch feelings to the operating portions.

Further preferably plural writing instruments in which the writing colors are differentiated for every writing instrument are made into one set, and the touch feelings of the operating portions of the writing instruments belonging to that set are mutually differentiated.

Further preferably the writing instrument is a ballpoint pen or a mechanical pencil.

According to another aspect of the present invention a writing instrument is provided which includes a number of reservoir tubes of different writing colors accommodated in a barrel, and a similar number of operating portions connected with the reservoir tubes, each for actuating a specific reservoir tube, said operating portions being exposed outside the barrel, each operating portion having a touch feeling means, the touch feeling means of each operating portion at least by one of the shape, hardness and position thereof being different from that of the touch feeling means of the other operating portions for differentiating by touch a specific one of the said operating portions for selecting one of the reservoir tubes for writing use.

Still according to another aspect of the invention a set of writing instruments is provided, in which each writing instrument includes a number of reservoir tubes of different writing colors accommodated in a barrel, and a similar number of operating portions connected with the reservoir tubes, each for actuating a specific reservoir tube, said operating portions being exposed outside the barrel, each operating portion having a touch feeling means, the touch feeling means of each operating portion at least by one of the shape, hardness and position thereof being different from that of the touch feeling means of the other operating portions for differentiating by touch a specific one of the said operating portions for selecting one of the reservoir tubes for writing use, each writing instrument further including further touch feeling means provided on the operating portions for differentiating the writing instruments of the set with each other.

BRIEF DESCRIPTION OF THE DRAWINGS

The invention will be explained in more detail hereinafter with reference to the drawings and embodiments thereof. In the drawings.

DESCRIPTION OF THE PREFERRED EMBODIMENTS

Figure 1:
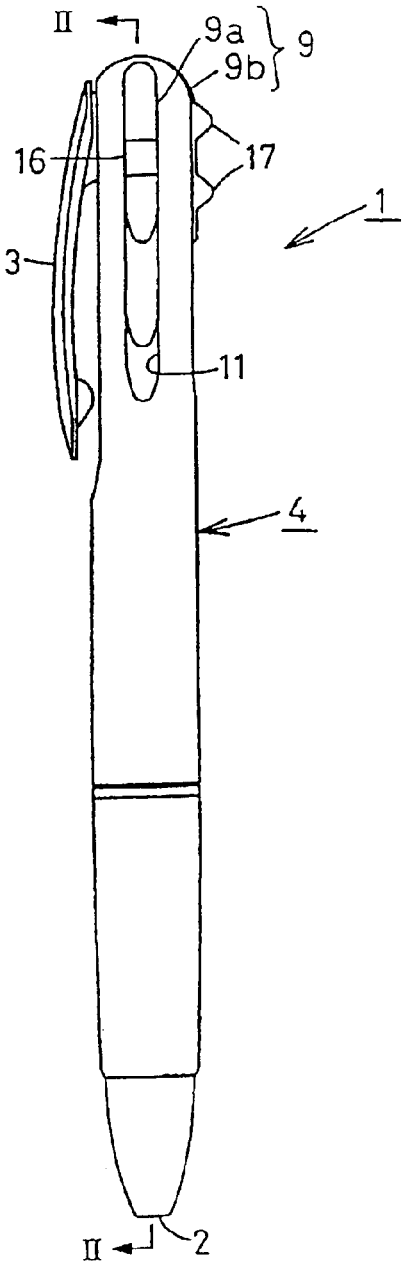
FIG. 1 is a right side view showing a writing instrument according to an embodiment of the invention.
Figure 2:
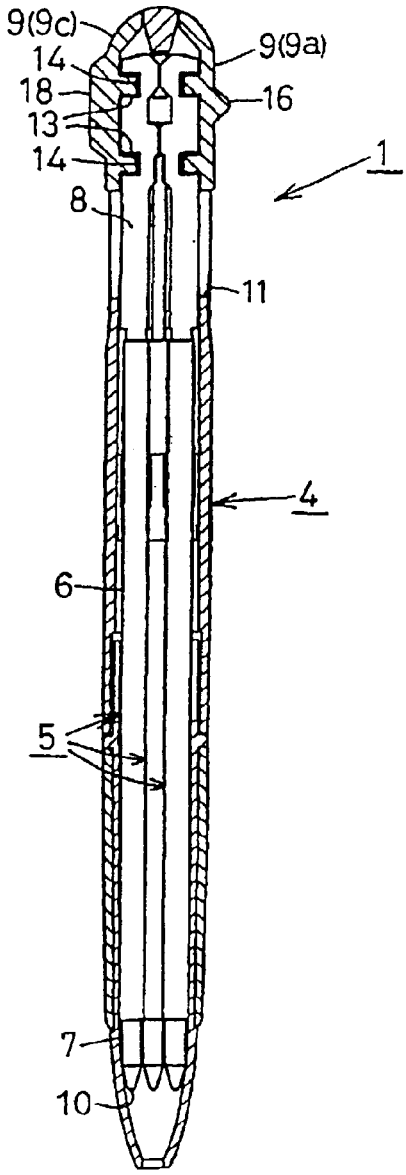
FIG. 2 is a sectional view along a line II—II in FIG. 1.
Figure 3:
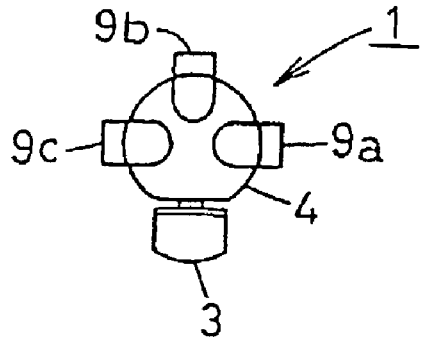
FIG. 3 is a plan view of the embodiment of the invention shown in FIG. 1.

FIG. 1 is a right side view showing an embodiment in which the invention is applied to a three-color ballpoint pen, FIG. 2 a sectional view along a line II—II in FIG. 1, and FIG. 3 a plan view.

A ballpoint pen 1 basically comprises a barrel 4 having an opening 2 at its front end and a clip 3 at its rear portion, and three reservoir tubes 5 accommodated in the barrel 4.

The reservoir tube 5 includes a tubular ink storage portion 6 for storing an ink therein, a tip 7 and an operating portion attaching piece 8 respectively attached to its front end and rear end. An operating portion 9 is provided in a rear side face of the operating portion attaching piece 8.

In the respective ink storage portions 6 of the tree reservoir tubes 5, inks different in writing colors, e.g., black, red and blue are respectively stored.

In a front end of the tip 7, a ball 10 for transferring the ink to a paper surface or the like is held such that a front end of the ball 10 is exposed.

The operating portion 9 is exposed outside from an axial slide hole 11 provided in a rear side face of the barrel 4. If the reservoir tube 5 of the desired writing color is selected and the operating portion 9 is slid forward by one of the operating portions 9 respectively provided in the three reservoir tubes 5 in which the inks different in writing colors are stored, the front end of the tip 7 of the selected reservoir tube 5 is exposed outside from the opening 2 of the barrel 4, so that a state ready for use is obtained.

After finishing the writing, by slightly sliding forward the operating portion 9 relating to any one of the other reservoir tubes 5 which have not been selected in the above, or by pushing the clip 3 in a center direction of the barrel 4, the tip 7 selected and exposed outside is automatically accommodated in the barrel 4 by an action of a not-shown spring or the like.

A so-called feeding mechanism of the reservoir tube 5 in a ballpoint pen or the like, in which the front end of the tip 7 of the reservoir tube 5 relating to the selected writing color is put in and out from the opening 2 of the barrel 4 by the operation of the operating portion 9 in this manner, is well-known and widely used.

In this specification, although an explanation about the feeding mechanism is omitted in order to avoid a redundancy, the well-known feeding mechanism can be optionally used.

The invention is characterized in that the touch feeling of the operating portions 9 relating to the three reservoir tubes 5 different in the writing colors are mutually differentiated.

As concrete means for mutually differentiating the touch feelings, there is enumerated a form in which the external shapes or hardness of the operating portions are mutually differentiated.

Among these, as a typical means for differentiating the external shapes, there is enumerated a form in which a convex portion or a concave portion is provided in a surface of the operating portion 9, and any of shape, number and position of the convex portion or the concave portion in the operating portion 9 of each reservoir tube 5 is differentiated.

Hereunder, it is concretely explained about this.

Figure 4:
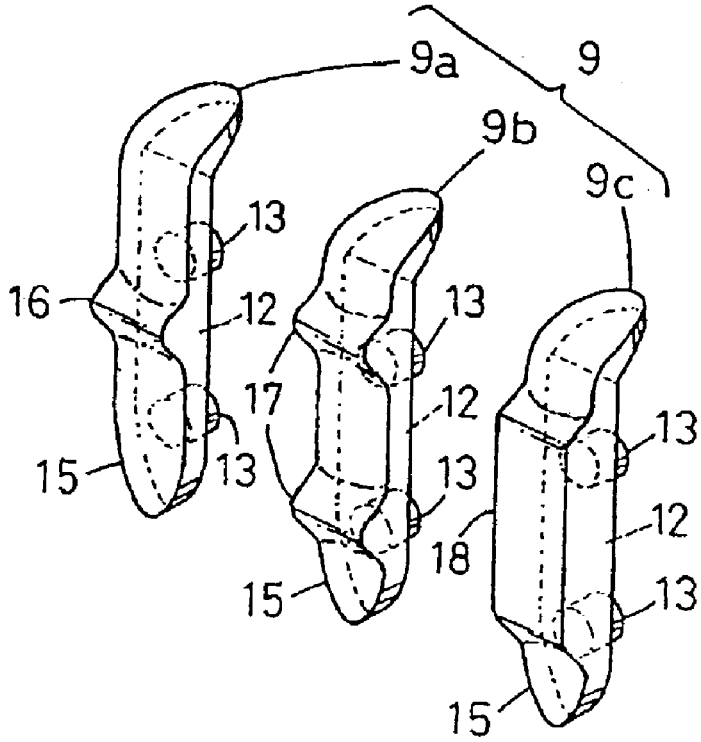
FIG. 4 is a perspective view showing a detail of the embodiment of the invention shown in FIG. 1 to FIG. 3 illustrating the operating portions provided with three reservoir tubes being detached.

FIG. 4 is a perspective view of the operating portions 9 provided in the three reservoir tubes 5 being detached of a ballpoint pen 1 shown in FIG. 1 to FIG. 3. Each of the operating portions 9*a*, 9*b* and 9*c* has a small plate-like form long in an axial direction of the barrel 4, and its rear portion is inwardly curved.

In a rear face of the operating portion 9, there are provided two attaching protrusions 13 in a back-and-forth direction. The operating portion 9 is attached to the reservoir tube 5 by fitting the attaching protrusions 13 to fitting holes 14 of an operating portion attaching piece 8 (see FIG. 2) in the reservoir tube 5. In respective surfaces of the three operating portions 9, convex portions are provided, namely a single central protrusion 16 of essentially triangle shape in side view is provided on a first operating portion 9*a*, two protrusions 17 of a same triangle shape are provided spaced from each other in the back-and-forth direction on a second operating portion 9*b*, and a single central protrusion 18 of trapezoid shape in side view is provided on a third operating portion 9*c*.

In this manner, by mutually differentiating the numbers or shapes of the protrusions 16, 17 and 18 of the operating portions 9*a*, 9*b* and 9*c* of the reservoir tubes 5 different in writing colors, the desired writing color can be easily selected even in a gloomy place or by even a person with poor eyesight, owing to the different touch feelings in operating the operating portions 9*a*, 9*b* and 9*c* by a finger, e.g., thumb, of a hand to thereby allow it to be used.

Figure 5:
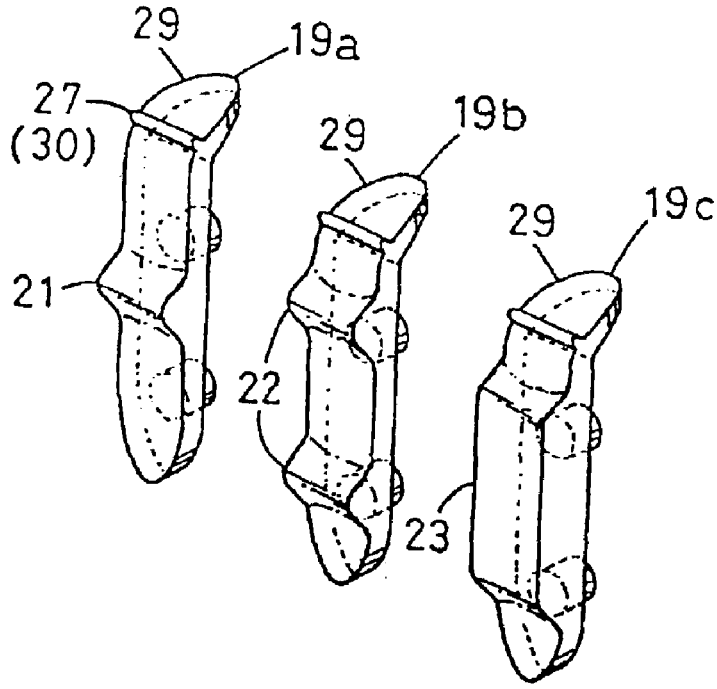
FIG. 5 is a perspective view similar to FIG. 4 of a first modification of the operating portions.
Figure 6:
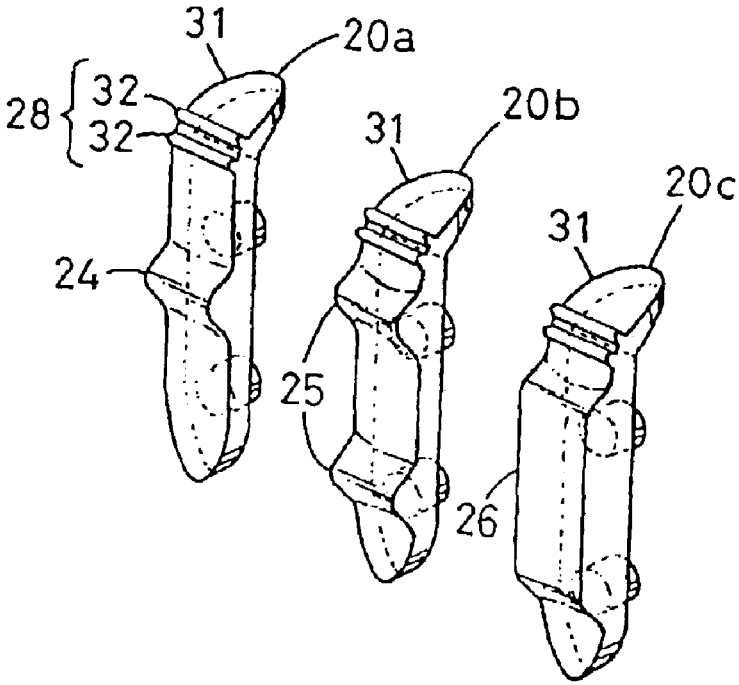
FIG. 6 is a perspective view similar to FIG. 4 of a second modification of the operating portions.

FIG. 5 and FIG. 6 are views showing another embodiment and corresponding to FIG. 4.

In this embodiment, a first ballpoint pen having operating portions 19*a*, 19*b* and 19*c* shown in FIG. 5 and a second ballpoint pen having operating portions 20*a*, 20*b* and 20*c* shown in FIG. 6 are made into one set.

The first ballpoint pen has different writing colors from the three writing colors of the second ballpoint pen, and therefore total six writing colors are differentiated to be used.

The operating portions 19*a*, 19*b* and 19*c*, and 20*a*, 20*b* and 20*c* of the first and second ballpoint pens are respectively provided with protrusions 21, 22 and 23, and 24, 25 and 26 similar to the case shown in FIG. 4.

The operating portions 19*a*, 19*b* and 19*c*, and 20*a*, 20*b* and 20*c* of the first and second ballpoint pens are additionally provided with discriminating elements 27 and 28 mutually different in their touch feelings in order to discriminate the first ballpoint pen from the second ballpoint pen.

That is, each of the operating portions 19*a*, 19*b* and 19*c* of the first ballpoint pen is provided in a surface of its curved portion 29 with one pen type discriminating protrusion 30, and each of the operating portions 20*a*, 20*b* and 20*c* of the second ballpoint pen is provided in a surface of its curved portion 31 with two pen type discriminating protrusions 32.

A user can easily discriminate the first ballpoint pen from the second ballpoint pen owing to the difference in the touch feeling of the pen type discriminating protrusions 30 and 32.

Generally, by making plural (for example, three or more) ballpoint pens whose writing colors are different each other into one set and by mutually differentiating the touch feelings of the operating portions of the respective ballpoint pens belonging to that set, desired writing color can be easily selected from among the many writing colors over the plural ballpoint pens to thereby present it for use, similarly to the embodiment shown in FIG. 5 and FIG. 6.

FIG. 7–FIG. 12 are views showing other embodiments of the invention and corresponding to FIG. 4.

Figure 7:
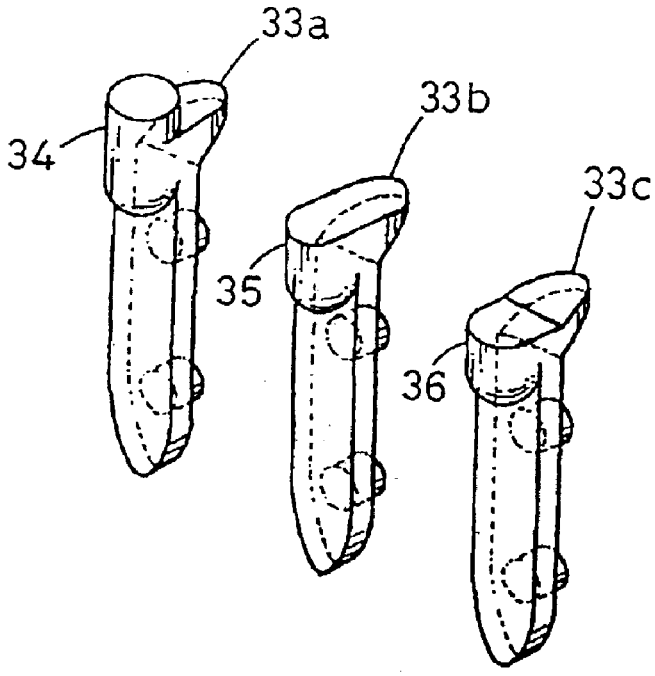
FIG. 7 is a perspective view similar to FIG. 4 of a third modification of the operating portions.

In the embodiment shown in FIG. 7, single protrusions 34, 35 and 36 are provided on the rear portions of the operating portions 33*a*, 33*b* and 33*c*, the touch feelings thereof are mutually differentiated. A first protrusion 34 provided on the associated operating portion 33*a* has a cylindrical shape protruding the operating portion 33*a*, a second protrusion 35 provided on the operating portion 33*b* has a cylindrical shape with a wide rounded outer face not protruding the operating portion 33*b*, and a third protrusion 36 has a cylindrical shape with a small plane outer face in a plane slightly below that the operating portion 33*b* terminates.

Figure 8:
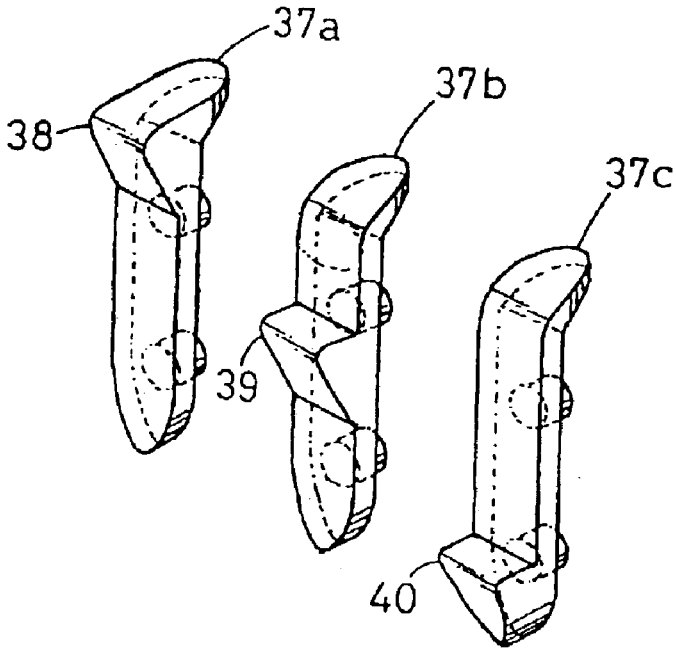
FIG. 8 is a perspective view similar to FIG. 4 of a fourth modification of the operating portions.

In the embodiment shown in FIG. 8, by differentiating the positions of the protrusions 38, 39 and 40 on the operating portions 37*a*, 37*b* and 37*c*, the touch feelings are mutually differentiated. Namely a first protrusion 38 is located near the upper axial end of a first one of the operating portions 37*a*, 37*b* and 37*c*, a second protrusion 39 at an intermediate location between the axial ends of a second one of the operating portions 37*a*, 37*b* and 37*c*, and a third protrusion 40 near a lower axial end of a third one of the operating portions 37*a*, 37*b* and 37*c*. Each protrusion 38, 39 and 40 can have a shape providing for a flat upper surface and an inclined lower surface.

Figure 9:
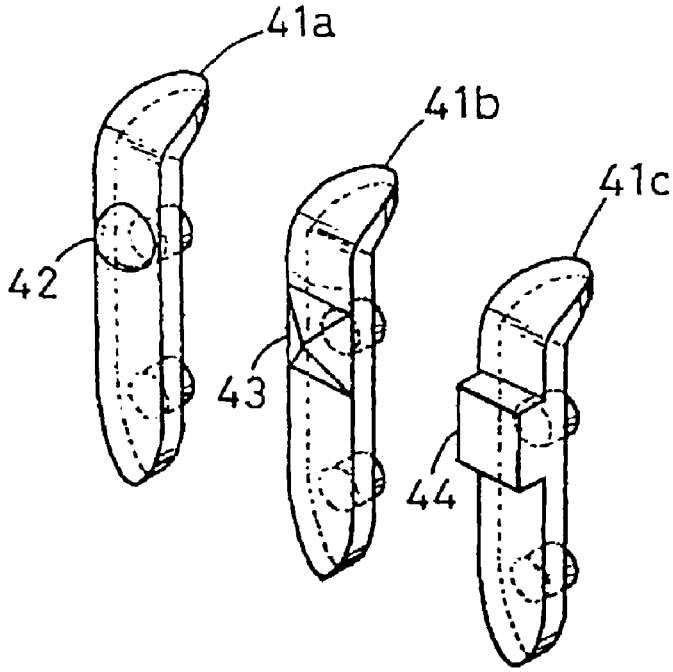
FIG. 9 is a perspective view similar to FIG. 4 of a fifth modification of the operating portions.

In the embodiment shown in FIG. 9, by differentiating shapes of protrusions 42, 43 and 44 provided on the operating portions 41*a*, 41*b* and 41*c*, the touch feelings are mutually differentiated. Namely one of the protrusions 42, 43 and 44 can have a half ball shape, another one of the protrusions 42, 43 and 44 a pyramid shape, and yet another one of the protrusions 42, 43 and 44 a rectangular shape.

Figure 10:
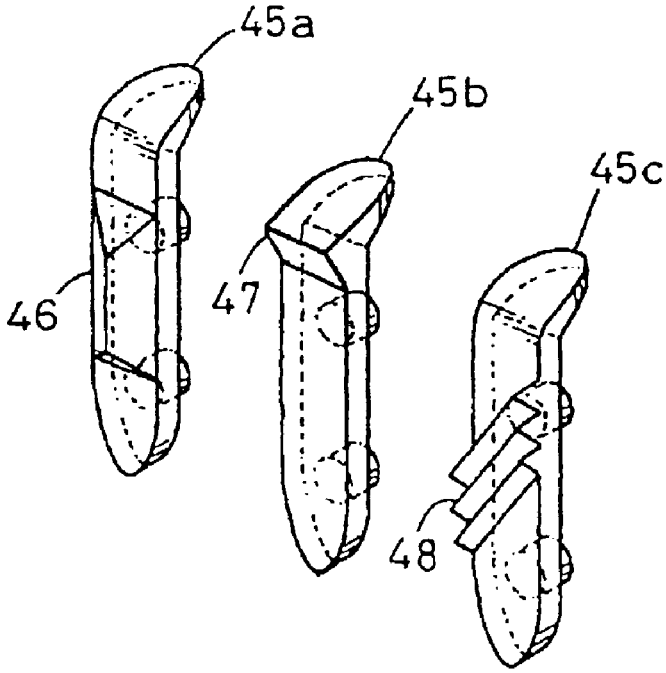
FIG. 10 is a perspective view similar to FIG. 4 of a sixth modification of the operating portions.

In the embodiment shown in FIG. 10, by differentiating the shapes, positions and numbers of protrusions 46, 47 and 48 provided on, the touch feelings are mutually differentiated. Namely a single roof shaped protrusion 46 is located at a center of one of the operating portions 45*a*, 45*b* and 45*c*, a single protrusion 47 having a triangular shape in side view is located near the upper axial end of another one of the operating portions 45*a*, 45*b* and 45*c*, and a corrugation pattern comprising a number, e.g. three inclined ridges is at a location intermediate the axial ends of the associated operating portion 45*c*.

Figure 11:
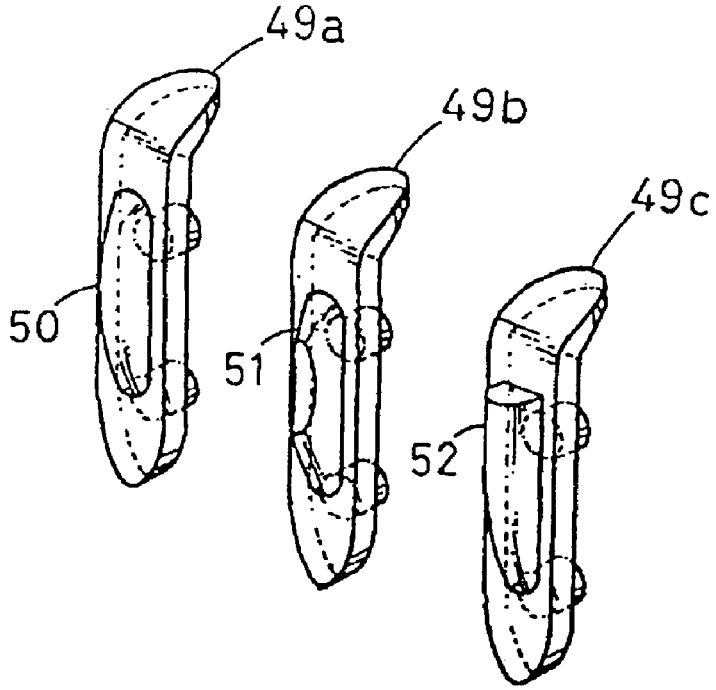
FIG. 11 is a perspective view similar to FIG. 4 of a seventh modification of the operating portions.
Figure 12:
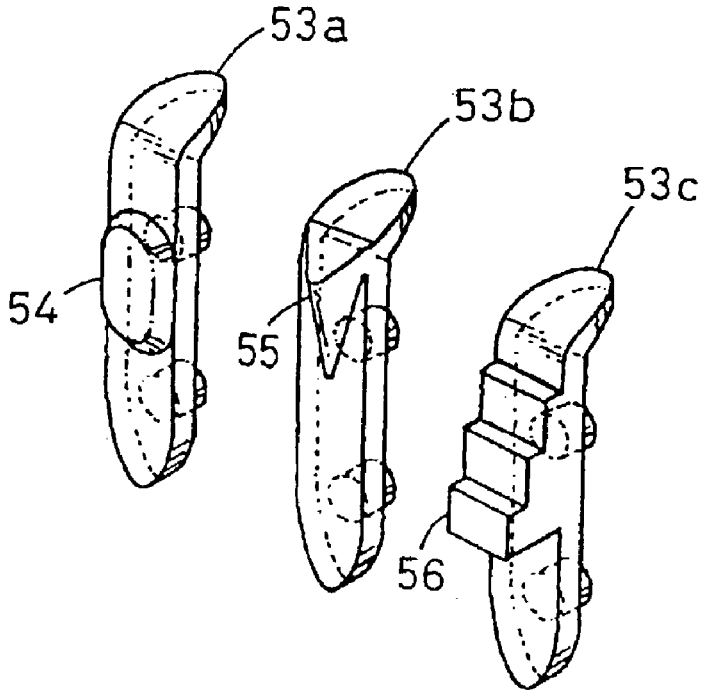
FIG. 12 is a perspective view similar to FIG. 4 of an eighth modification of the operating portions.

In FIG. 11 and FIG. 12 further embodiments of the invention are shown in which by differentiating the shapes of protrusions 50, 51 and 52, and 54, 55 and 56 provided on the operating portions 49*a*, 49*b* and 49*c*, and 53*a*, 53*b* and 53*c*, the touch feelings thereof are mutually differentiated.

Besides the embodiments explained above, for example, by suitably combining the protrusions shown in FIG. 4–FIG. 12, one set of operating portions having mutually different touch feelings may be made.

Additionally, even for the protrusions whose shapes, numbers and positions are the same, the touch feelings may be mutually differentiated by differentiating the hardness or haptic properties of the protrusions.

According to the invention, since the touch feelings of the operating portions of the reservoir tubes having different writing colors are mutually differentiated, a desired writing color can be easily selected by the finger of hand even in a gloomy place and even by a person with poor eyesight to thereby present it for use. A desired writing color can be easily selected from among many writing colors of a number of ballpoint pens to thereby present a specific one for use. A ballpoint pen or a mechanical pencil which provides the above mentioned advantages can be obtained.

The above description of embodiments of the invention has been given by way of example. From the disclosure given, those skilled in the art will not only understand the present invention and the attendant advantages, but will also find apparent various changes and modifications to the structures disclosed. It is sought, therefore, to cover all such changes and modifications as within the spirit and scope of the invention, as defined by the appended claims, and equivalents thereof.

What is claimed is:

1. A writing instrument including a number of reservoir tubes of different writing colors accommodated in a barrel, and a similar number of operating portions connected with the reservoir tubes, each for actuating a specific reservoir tube, said operating portions being exposed outside the barrel, each operating portion having a touch feeling means, the touch feeling means of each operating portion configured for differentiating by touch a specific one of the said operating portions for selecting one of the reservoir tubes for writing uses;

wherein the touch feeling means of the respective operating portions comprise respectively differing hardnesses of the operating portions.

2. A writing instrument according to claim 1, wherein the touch feeling means comprise protrusions of different shape.

3. A writing instrument according to claim 1, wherein the touch feeling means comprise protrusions of same shape provided on different sites of the operating portions.

4. A writing instrument according to claim 1, wherein the writing instrument is a ballpoint pen.

5. A writing instrument according to claim 1, wherein the writing instrument is a mechanical pencil.

6. A set of writing instruments, in which each writing instrument including a number of reservoir tubes of different writing colors accommodated in a barrel, and a similar number of operating portions connected with the reservoir tubes, each for actuating a specific reservoir tube, said operating portions being exposed outside the barrel, each operating portion having a touch feeling means, the touch feeling means of each operating portion configured for differentiating by touch a specific one of the said operating portions for selecting one of the reservoir tubes for writing use, each writing instrument further including further touch feeling means provided on the operating portions for differentiating the writing instruments of the set with each other;

wherein the touch feeling means of the respective operating portions comprise respectively differing hardnesses of the operating portions.

7. A set of writing instruments according to claim 6, wherein the writing instruments comprise set of ball point pens.

8. A set of writing instruments according to claim 6, wherein the writing instruments comprise a set of mechanical pens.

* * * * *